US010080954B2

(12) United States Patent
Dunham

(10) Patent No.: US 10,080,954 B2
(45) Date of Patent: Sep. 25, 2018

(54) POKER-INCORPORATED SPORTS

(71) Applicant: POKER RODEO ASSOCIATION, INC., Vista, CA (US)

(72) Inventor: Stephen R. Dunham, Carlsbad, CA (US)

(73) Assignee: POKER RODEO ASSOCIATION, INC., Vista, CA (US)

( * ) Notice: Subject to any disclaimer, the term of this patent is extended or adjusted under 35 U.S.C. 154(b) by 0 days.

(21) Appl. No.: 15/799,015

(22) Filed: Oct. 31, 2017

(65) Prior Publication Data

US 2018/0126253 A1 May 10, 2018

Related U.S. Application Data

(62) Division of application No. 15/176,817, filed on Jun. 8, 2016.

(60) Provisional application No. 62/185,103, filed on Jun. 26, 2015.

(51) Int. Cl.

| | |
|---|---|
| ***A63F 1/00*** | (2006.01) |
| ***A63F 1/04*** | (2006.01) |
| *A63K 3/00* | (2006.01) |

(52) U.S. Cl.
CPC ..... *A63F 1/04* (2013.01); *A63F 1/00* (2013.01); *A63F 2001/005* (2013.01); *A63K 3/00* (2013.01)

(58) Field of Classification Search
CPC ..... A63F 1/04; A63F 1/00
See application file for complete search history.

(56) References Cited

U.S. PATENT DOCUMENTS 4,781,377 A * 11/1988 McVean ..... A63F 3/00082 119/702
2008/0197573 A1* 8/2008 Palmer ..... A63F 1/04 273/298

* cited by examiner

*Primary Examiner* — Michael Dennis
(74) *Attorney, Agent, or Firm* — One LLP; Joseph K. Liu

(57) ABSTRACT

A poker-incorporated sports game is provided. The sports game includes elements each bearing indicia, or marking, of a playing card, such as playing cards used in a poker card game. The participants of the sports game have to perform and meet one or more predetermined challenges or tasks to achieve a poker hand from the elements. The participants strive to meet the challenges in the shorted time possible. An algorithm is then used to calculate the score of each participant, based on the value of the poker hand of and time used by the participant to achieve the poker hand.

6 Claims, 4 Drawing Sheets

| Hand | Combinations | Probability | -log(Probability) | Human Psychology and Interference Factor (HPIF) | Score Mult. (60 Sec.) | (75 Sec.) | (90 Sec.) | (120 Sec.) |
|---|---|---|---|---|---|---|---|---|
| Royal Flush | 4 | 0.0000407 | 4.39 | 3.87 | 17.00 | 13.60 | 11.33 | 8.50 |
| Straight Flush | 8 | 0.0000814 | 4.09 | 3.67 | 15.00 | 12.00 | 10.00 | 7.50 |
| Four of a Kind | 168 | 0.0017094 | 2.77 | 1.99 | 5.50 | 4.40 | 3.67 | 2.75 |
| Full House | 1008 | 0.0102564 | 1.99 | 3.02 | 6.00 | 4.80 | 4.00 | 3.00 |
| Flush | 72 | 0.0007326 | 3.14 | 2.07 | 6.50 | 5.20 | 4.33 | 3.25 |
| Straight | 3060 | 0.0311355 | 1.51 | 5.31 | 8.00 | 6.40 | 5.33 | 4.00 |
| Three of a Kind | 6720 | 0.0683761 | 1.17 | 3.43 | 4.00 | 3.20 | 2.67 | 2.00 |
| Two Pair | 15120 | 0.1538462 | 0.81 | 2.46 | 2.00 | 1.60 | 1.33 | 1.00 |
| Pair | 53760 | 0.5470085 | 0.26 | 5.73 | 1.50 | 1.20 | 1.00 | 0.75 |
| High Card | 18360 | 0.1868132 | 0.73 | 1.37 | 1.00 | 0.80 | 0.67 | 0.50 |
| TOTAL | 98280 | 1 | | | | | | |

FIG. 4

POKER-INCORPORATED SPORTS

CROSS-REFERENCE TO RELATED APPLICATIONS

The present application is a divisional of U.S. patent application Ser. No. 15/176,817, filed Jun. 8, 2016, which claims benefit of priority with U.S. Provisional Application No. 62/185,103, filed Jun. 26, 2015, which is hereby incorporated by reference.

FIELD

The claimed invention relates to sports games, and more particularly to sports games that incorporate poker rules and strategies.

BACKGROUND

Currently sports games rely on the speed, skill, and athleticism of the players. Some games also rely on team strategy. In the equestrian field, rodeo games rely on the speed and skill of the horseback riders. These equestrian games can also be played in a team of riders, and can also require some team strategies. However, the strategies used in sports games do not have fun or entertainment aspects and therefore are mostly boring and still rely mostly on the speed of the players to determine the winners. For example, in the games of cattle penning and cattle sorting, the riders compete based on time. The event gives a team of two or three riders on horseback from 60 to 90 seconds to separate a number of specifically identified cattle from a herd of ten or 30, and put them into a pen or adjacent arena through an opening. The rules have been the same for years.

It is therefore desirable to provide methods and systems for sports games using poker strategies, and that provide advantages heretofore unknown in the art.

SUMMARY OF THE INVENTION

Provided herein are embodiments of a poker-incorporated sports game. The sports game includes elements each bearing indicia, or marking, of a playing card, such as playing cards used in a poker card game. The participants of the sports game have to perform and meet one or more predetermined challenges or tasks to achieve a poker hand from the elements. The participants strive to meet the challenges in the shortest time possible. An algorithm is then used to calculate the score of each participant, based on the value of the poker hand and time taken by the participant to achieve the poker hand.

In some embodiments, a poker rodeo sports game is provided. The sports game includes cattle penning in which each cow is attached with an indicia, or marking, of a playing card, such as playing cards used in a poker card game. A herd of cattle includes 28 cattle. A team of horseback riders, for example, a team of two or three riders, cuts and sorts or pens five cattle into a designated pen. The cattle in the pen, with their attached playing card indicia, represent a poker hand. An algorithm is used to determine a score. The algorithm includes the value of the poker hand, and time taken to achieve the poker hand.

In some embodiments, a method for playing a poker rodeo sports game is provided. The method includes attaching a card indicia to each cow in a herd of cattle; bunching the herd of cattle each attached with a card indicia into a designated area of an arena; randomly selecting a hole card which is represented by a cow that is attached with a card indicia matching the hole card. A team of horseback riders cuts and/or pens the cow attached with a card indicia matching the hole card into a designated pen area of the arena. The team also cuts and pens four additional cattle into the pen. The cattle in the pen, with their attached playing card indicia, represent a poker hand. An algorithm is used to determine a score. The algorithm includes the value of the poker hand multiplied by the team's speed and/or time used to achieve the poker hand.

BRIEF DESCRIPTION OF THE SEVERAL VIEWS OF THE DRAWINGS

Illustrated in the accompanying drawing(s) is at least one of the best mode embodiments of the present invention. In such drawing(s):

FIG. 4 illustrates scoring multiplier, human psychology and interference factor (HPIF), and probability of randomly achieving poker hands.

DETAILED DESCRIPTION OF THE PREFERRED EMBODIMENTS

Figure 1:
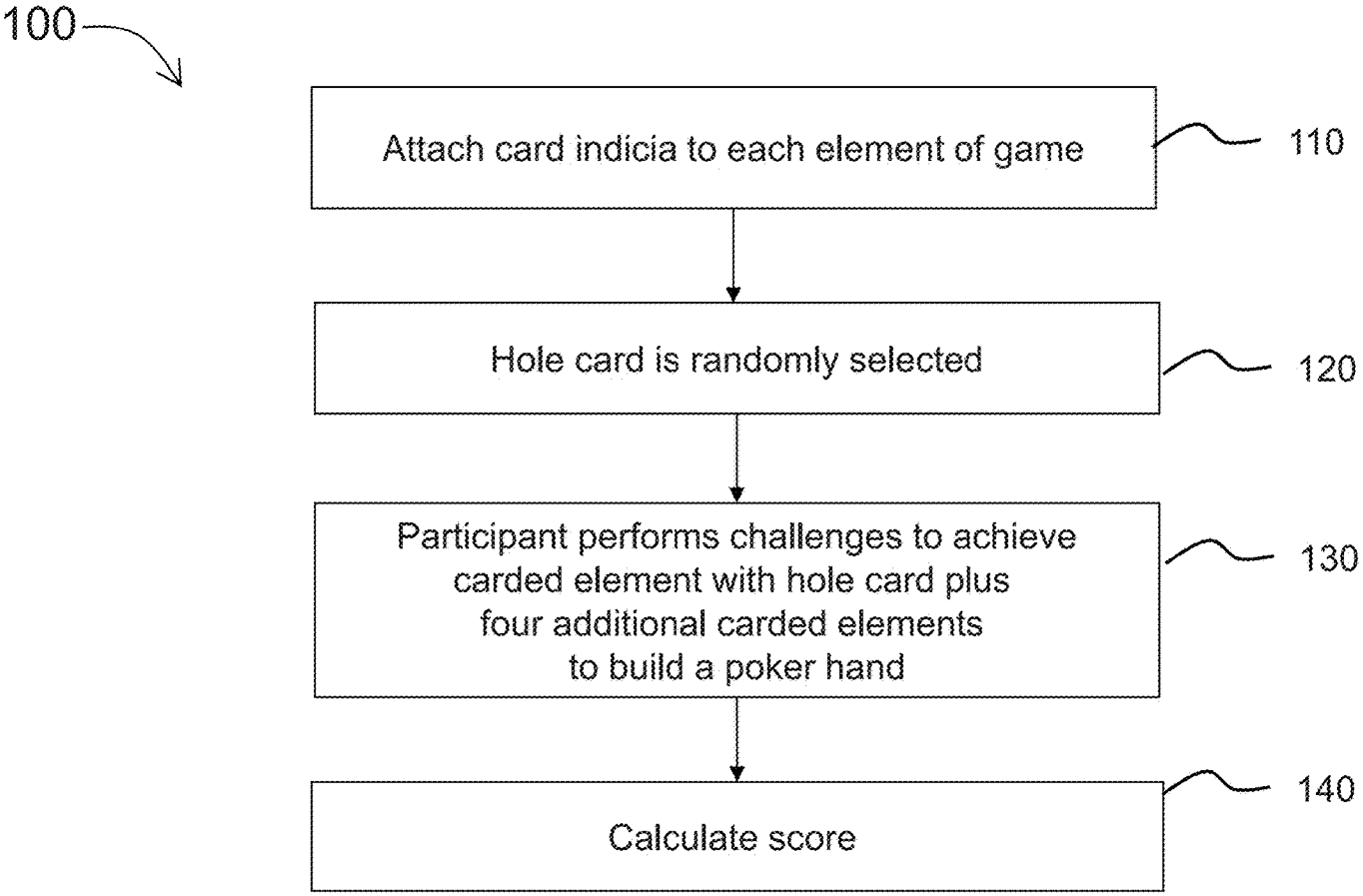
FIG. 1 illustrates an exemplary flowchart for a sports game according to an embodiment of the present invention.

The below described drawing figures illustrate the described apparatus and its method of use in at least one of its preferred, best mode embodiment, which is further defined in detail in the following description. While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated. All features, elements, components, functions, and steps described with respect to any embodiment provided herein are intended to be freely combinable and substitutable with those from any other embodiment unless otherwise stated. Those having ordinary skill in the art may be able to make alterations and modifications to what is described herein without departing from its spirit and scope. Therefore, it should be understood that what is illustrated is set forth only for the purposes of example and should not be taken as a limitation on the scope of the present invention and its method of use.

In the following description and in the figures, like elements are identified with like reference numerals. The use of "e.g.," "etc," and "or" indicates non-exclusive alternatives without limitation, unless otherwise noted. The use of "including" or "includes" means "including, but not limited to," or "includes, but not limited to," unless otherwise noted.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B", when used in conjunction with open-ended language such as "comprising" can refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

Turning to the drawings, FIG. 1 illustrates an exemplary flowchart for a sports game 100 that incorporates one or more rules and strategies of poker. Generally, the sports game 100 may include elements each bearing indicia, or marking, of a playing card, such as playing cards used in a poker card game. The participants of the sports game 100 may have to perform and meet one or more predetermined challenges or tasks to achieve a poker hand from the elements. The participants strive to meet the challenges in the shortest time possible. An algorithm may then be used to calculate the score of each participant, based on the value of the poker hand of and time taken by the participant to achieve the poker hand. In some embodiments, the winning participant may be determined by the highest score. In some embodiments, the sports game 100 may be timed, for example, a participant may have a fixed time, for example, 60 or 90 seconds, to achieve a poker hand. A participant who cannot achieve a poker hand may be disqualified. Thus, the sports game 100 takes into consideration the skills, strategies, athleticism, and speeds of the participants in a timed event to build a poker hand with elements bearing indicia of playing cards.

At Step 110, which may be performed before the start of the sports game 100, each element of the sports game 100 is attached with an indicia, or marking, of a playing card. A hole card may be randomly selected and presented to the participant (Step 120). The participant then performs one or more predetermined challenges (Step 130). The challenges are defined so that when they are met, corresponding carded elements (elements bearing card indicia) are awarded to the participant and become part of his or her poker hand. The participant's goal is to meet the challenges to obtain the element bearing the indicia of the hole card, and four more card elements to build a five-card poker hand. In some embodiments, an algorithm may be used to calculate the score of each participant, based on the value of the poker hand of and time and/or speed taken by the participant to achieve the poker hand.

In some embodiments, the predetermined challenges may be different for each carded element.

In some embodiments, a poker hand may be pre-designated for the participant who will have to achieve the carded elements representing the pre-designated hand.

In some embodiments, the sports game 100 is an equestrian game, for example, poker penning, poker sorting, poker sort and rope. In some embodiments, horseback riders may have to clear an obstacle course that has associated cards to create a poker hand. Some other exemplary embodiments include a poker sorting or penning game as described herein.

The poker concept of the sports game 100 may also be suitable to other sports games, for example, to target shooting game where the participant may be presented with a deck of card targets which the participant may shoot to create a poker hand. In some embodiments, the number of elements may be flexible. For example, there may be 28 elements, or there may be 52 elements. A 52 carded elements represent a full deck of cards.

In some embodiments, an application may be provided to spectators of the sports game 100 to guess the winning rider or the winning team. The application may be downloaded to a wireless device, for example, a tablet, a smart phone, a laptop, or any other wireless device with a wireless communication interface known in the art.

In some embodiments, the card indicia may be displayed on a support or platform that is sufficiently large to be visible to the spectators. In some embodiments, for example when the elements of the game are animals, the support may be a harness applied to both sides of the animals. The support may also include space for branding and/or advertising. Each side of the harness may include a card made from a reusable hybrid vinyl UV resistant material, printed with image of a playing card. In some embodiments, to improve visibility, blue color may be used for the numbers and/or letters, and large red or black suit may be used for hearts, diamonds, spades and clubs for the cards.

Figure 2:
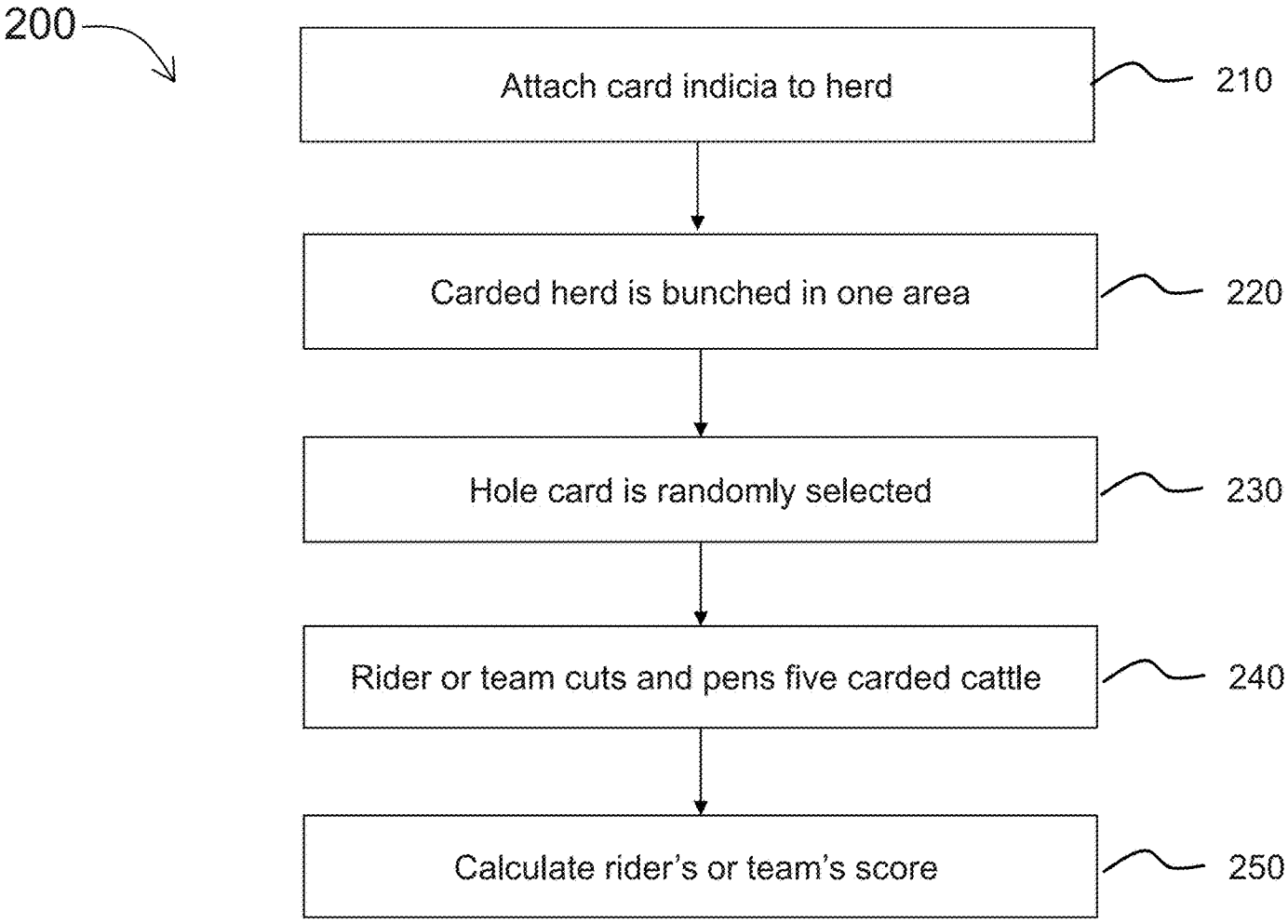
FIG. 2 illustrates an exemplary flowchart for a sports game of poker penning and sorting according to an embodiment of the present invention.

FIG. 2 illustrates an exemplary flowchart for a sports game 200 that incorporates one or more rules and strategies of poker for the sports of poker penning and sorting. Generally, the sports game 200 includes cattle penning in which each cow is attached with an indicia, or marking, of a playing card, such as playing cards used in a poker card game. As described herein, a harness may be used to attached the card indicia to the cow. A herd of cattle may include at least 28 cattle, and as many as 52 cattle. A team of horseback riders, for example, a team of two or three riders, will cut and sort or pen three to five cattle into a designated pen. The cattle in the pen, with their attached playing card indicia, may represent a poker hand. An algorithm may be used to determine a score. The algorithm may include the value of the poker hand, speed and/or time taken to achieve the poker hand. In some embodiments, a team includes only one participant. The sports game 200 may be referred to herein as poker penning, or team poker penning.

It should be noted that although cattle is described, other animals may also be used in the sports game 200. For example, sheep, goats, or chicken, may be used.

At Step 210, to prepare for the game, each cow in the herd may be attached with an indicia of a playing card. As described herein, a harness may be used to attached the card indicia to the cattle. The harness may be sufficiently large to hold card indicia visible to the spectators as well as participants. As described herein, each side of the harness may include a card made from a reusable hybrid vinyl UV resistant material, printed with image of a playing card. In some embodiments, to improve visibility, blue color may be used for the numbers and/or letters, and large red or black suit may be used for hearts, diamonds, spades and clubs for the cards.

In some embodiments, the herd may include 28 cattle, each is attached with a card indicia, for example, using a harness or harness-like device. In these embodiments, card ranks, or values, 2 through 7 of each suit may not be used. Card values 8 through 10, Ace, King, Queen and Jack of each suit may be used. A herd of 28 cows may be more efficient for the riders to navigate, and may be more cost efficient for the game.

In some embodiments, card indicia may be painted on the cattle.

Although the preferred number is 28 cattle, in some embodiments, the herd may include 52 cows, each is attached with a card indicia. Other number of cows is also contemplated.

In some embodiments, after the cattle herd is bunched up, or herded into an area, for example a designated area, of the arena (Step 220), a hole card may be randomly selected (Step 230). The hole card may be selected by an official, such as a judge, or by an application, such as a software application downloaded and installed in a wireless device, for example, a tablet, a smart phone, a laptop, or any other wireless device with a wireless communication interface known in the art. The hole card is represented by a cow attached with a card indicia matching the hole card. Similar to a game of poker where a hole card is dealt to a player, the hole card selected at Step 230 is given to a rider, or a team of riders, at or about the start of the game. The rider or the team of riders may start from a judge line near the center of the arena. In some embodiments, the hole card is given when the rider or the team of riders passes through a gate.

The rider or the team of riders will then have to cut and sort or pen the cow bearing the indicia of the selected hole card, plus four more cows (Step 240). In some embodiments, the cow bearing the hole card indicia must be penned first, as this may be more difficult when the cow is situated in the middle of the full herd. Having to achieve the hole card first also forces the rider or the team not to pick an easy hand from the front of the herd. When the rider or the team enters the herd to cut and sort the cow bearing the hole card, the herd is effectively shuffled, making the game more challenging and interesting.

The four additional cows are chosen by the rider or by the team of riders. The five carded cows (cattle bearing card indicia) once cut and penned will make a five-card poker hand of the rider or of the team. The rider or the team should want to cut and pen the five cows in their fastest possible time. In some embodiments, the sports game 200 may be timed, for example, a rider or a team may have a fixed time to achieve a poker hand, for example, 60 or 90 seconds. A rider or a team of riders who cannot achieve a poker hand may be disqualified. A rider or a team of riders may also be disqualified when more than five cows are penned.

Other rules of non-poker based cattle penning may also be applied to the sports game 200.

In some embodiments, an algorithm may be used to calculate the score of each rider or each team, based on the value of the poker hand of and the time taken by the rider or the team to achieve the poker hand represented by the penned carded cows (Step 250).

Figure 3:
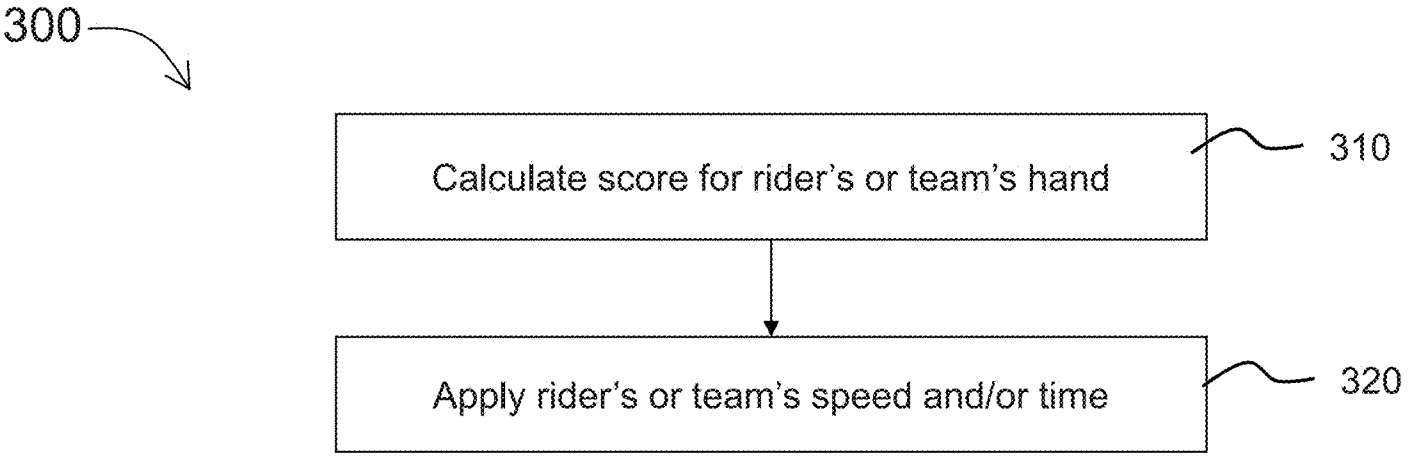
FIG. 3 illustrates an exemplary flowchart for an algorithm for a sports game according to an embodiment of the present invention.

FIG. 3 illustrates an exemplary flowchart for an algorithm 300. At Step 310, the algorithm 300 calculates a score for the rider or the team based on the poker hand of the rider or of the team. At Step 320, the algorithm 300 applies the speed and/or time the rider or the team took to penned the five carded cattle to return a final score. Time may be measured to the thousandth of a second using a multiplier of the value of the poker hand and the number of seconds under the limit a rider or a team has left on the game clock. The team must have successfully penned their poker hand, including their hole card, with no dirty (unintended) cattle on the pen side of a foul line, to receive a final score. In some embodiments, a score may be awarded to each team member individually to count toward his or her average. The highest average of the event may be the winner.

The algorithm 300 may include scoring multipliers to ensure fair, fun, and sustainable competition on a cattle herd, for example, a herd of 28 cows. Scoring multipliers for each poker hand contemplate the probability of riders randomly achieving the poker hand and also include a human psychology and interference factor (HPIF). The HPIF adjusts scoring multipliers taking into consideration that riders consciously and intently select their cows to be cut from the herd using analytical thinking, time management, strategy, and riding skills. Exemplary scoring multiplier, HPIF, and probability of randomly achieving each poker hand are illustrated in FIG. 4.

The algorithm 300 takes into consideration the poker hands considered to be less-likely in poker, such as a four-of-a-kind, are generally psychologically easier to achieve while riding. For example, four-of-a-kind hands may be achieved twenty five times more frequently than the royal flush and straight flush hands combined. The mental processing aptitude required to achieve more abstract hands, such as an out-of-order royal flush, straight flush, or straight, especially when combined with time pressure and a dynamic riding environment, may be far greater than that of a four-of-a-kind, three-of-a-kind or a full-house. The algorithm 300 substantially rewards riders who process more difficult hands with a fast time.

The HPIF factor represents the adjustment needed to affect the score multiplier for each clock setting. A rider or a team's score may be calculated by multiplying a score multiplier by the number of seconds left on the clock. For example, on a sixty-second clock, a team that achieves a royal flush in 50 seconds will earn a score of 170. The ten seconds left on the clock (since they used 50 of the allotted 60 seconds) is multiplied by the score multiplier (17, as illustrated in FIG. 4 for Royal Flush) as follows: $10\times17=170$. All scores may be instantly calculated using a scoring application.

While speed may be the major multiplying factor early in the rider's or the team's ride, the value of their poker hand gains increasing multiplier value as time on the clock is reduced. Thus, communication between riders may be critical to achieving a better poker hand with a faster time for a higher score.

In the event of a tie score, each rider or team may be allowed to pen one randomly selected "card" in the herd. The fastest time breaks the tie, regardless of the value of the "card".

In some embodiments, an application may be provided to spectators of the sports game 200 to guess the winning rider or the winning team. The application may be downloaded to a wireless device.

A simulation software application may be provided to familiarize a user with the system and method described herein. A graphical user interface (UI) may be provided by the application. In some embodiments, a user may touch a card image displayed in the UI, for example, on a smartphone, and the card flips over. The card may indicate the selected hole card. The user then presses a start button to begin a timer, for example, to indicate the start of a game. The user presses a stop button, for example, to indicate the end of a game. After the stop button is pressed, possible poker hands may appear on the screen. The user selects the hand, for example, "Full House," and a score is calculated.

A producer software application may also be provided. The producer application may include a robust system for checking in riders, selecting which classes they want to ride in, creating teams for the riders, and so on. Once the teams are built, they may appear as a list in a UI, which may be printed. On a UI screen after the teams are built, the user may select a start, for example, "Play Sport" button. With provided UI screens, the producer may announce the teams, touch the card to flip it and to indicate a hole card, run the timer, stop the timer, select the hand the team has achieved, and receive a score. The score may be automatically saved. In some embodiments, once the application is downloaded to a wireless device, it can be operated with no wireless signal or Internet connection. After the sports event is completed, the producer may upload the results onto a database, where an application manages all rider scores, best hands of teams, fastest teams, best averages, a national leaderboard, etc.

In some embodiments, a poker race game may be provided. Race animals, for example, race horses, may be equipped with playing card indicia either physically or electronically. As described herein, a harness may be used to attached the card indicia to the animal. Before the race, a user may receive two cards. The user may receive the two cards via a software application, as described herein, on a wireless device. At the end of the race, the first, second and third place animals, plus the two cards received by the user will represent a poker hand. In some embodiments, where a seven-card hand is used, the first to fifth place animals, plus the two cards received by the user will represent a poker hand. In some embodiments, a wagering pot may be created from which winners may split based on the values of their poker hands, in consideration of their bets.

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the described subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims, if any, and it is made clear, here, that each named inventor believes that the claimed subject matter is what is intended to be patented.

What is claimed is:

1. A method for playing a poker penning sports game comprising:

attaching a harness, with two sides and including a card indicia on each side, to each animal of a plurality of animals;

bunching the plurality of animals, each animal attached with a harness, with two sides and a card indicia on each side, into a designated area of an arena, wherein each card indicia is made of a hybrid vinyl ultraviolet resistant material, printed with an image of a playing card;

randomly selecting a hole card which is represented by an animal of a plurality of animals, the animal being attached with a card indicia matching the hole card;

cutting and penning, by a team of horseback riders, the animal being attached with a card indicia matching the hole card into a designated pen area of the arena;

cutting and penning, by the team of horseback riders, four additional animals into the designated pen area of the arena; and calculating, using an algorithm, a score.

2. The method of claim 1, wherein five animals cut and penned into the designated pen area represent a five-card poker hand.

3. The method of claim 1, wherein the algorithm includes the value of the five-card poker hand and a time taken to achieve the five-card poker hand.

4. The method of claim 1, wherein the algorithm includes a scoring multiplier for the five-card poker hand.

5. The method of claim 4, wherein the scoring multiplier includes a human psychology and interference factor.

6. The method of claim 1 further comprises a software application for calculating the score.

* * * * *